United States Patent [19]

Park

[11] Patent Number: 4,492,370

[45] Date of Patent: Jan. 8, 1985

[54] QUICK RELEASE CLAMPING DEVICE

[76] Inventor: Kyoo P. Park, 4657-208A St., Langley, British Columbia, Canada

[21] Appl. No.: 440,503

[22] Filed: Nov. 10, 1982

[51] Int. Cl.[3] ..... B25B 1/02

[52] U.S. Cl. ..... 269/182; 269/181

[58] Field of Search ..... 269/181, 182, 247

[56] References Cited

U.S. PATENT DOCUMENTS 4,262,892 4/1981 Wu ..... 269/181

*Primary Examiner*—Frederick R. Schmidt
*Assistant Examiner*—Judy J. Hartman
*Attorney, Agent, or Firm*—Carver & Co.

[57] ABSTRACT

A clamping device comprises a first jaw member and a second jaw member. A screw has a screw spindle rotatably mounted on the first jaw member. A half nut is mounted on the second jaw member. A cam operatively connects the screw to the half nut so that the half nut is engaged with the screw or disengaged from the screw by rotation of the screw.

5 Claims, 6 Drawing Figures

QUICK RELEASE CLAMPING DEVICE

BACKGROUND OF THE INVENTION

This invention relates to a quick releasing clamping device wherein a half nut is engaged with screw or disengaged from the screw by rotation of the screw.

Common clamping devices, particularly vises, include a pair of opposing jaw members which are brought into engagement with each other or moved away from each other by rotation of a screw which interconnects the members. A relatively fine thread is frequently used on the screw in order to increase the clamping force. This means that moving the jaw members apart by rotation of the screw is a relatively slow process. Quick release mechanisms have therefore been developed to move the jaw members apart more quickly. Prior art devices of this type typically include a screw rotatably mounted on one of the members and a half nut mounted on the other member. A separate lever on the front of the vise can move the half nut into engagement with the screw or move the half nut away from the screw. In this way the vise is capable of quick release as well as instantaneous grip. However, it should be noted that the operation of such a vise may require two hands: one to move the lever and the other to move the jaws of the vise.

For some purposes it is desirable to provide single-handed operation of the vise. This could be achieved by a quick release and instantaneous grip mechanism operated by the handle typically connected to the screw.

SUMMARY OF THE INVENTION

A clamping device comprises a first jaw member and a second jaw member. A screw has a screw spindle rotatably mounted on the first jaw member. A half nut is mounted on the second jaw member. A cam means operatively connects the screw to the half nut so that the half nut is engaged with the screw or disengaged from the screw by rotation of the screw.

Gear means may connect the screw to the cam means. The gear means may comprise a gear wheel connected to the screw and a gear wheel segment connected to the cam means.

In a preferred form, the cam means comprises a cam and a cam follower, the half nut being mounted on the cam follower and the gear wheel segment being connected to the cam.

There may be resilient means connecting the gear wheel segment and the cam. For example, a cam spindle may be connected to the cam, the gear wheel segment being rotatably mounted on the cam spindle and the resilient means connecting the gear wheel segment to the cam spindle.

When compared with the prior art, the present invention offers the advantage of a quick release and instantaneous grip vise operable by a single control, namely a handle mounted on the screw. One handed operation is thereby possible. At the same time, the invention provides a relatively simple and rugged mechanism capable of a long reliable operating life.

DESCRIPTION OF THE PREFERRED EMBODIMENTS

Figure 1:
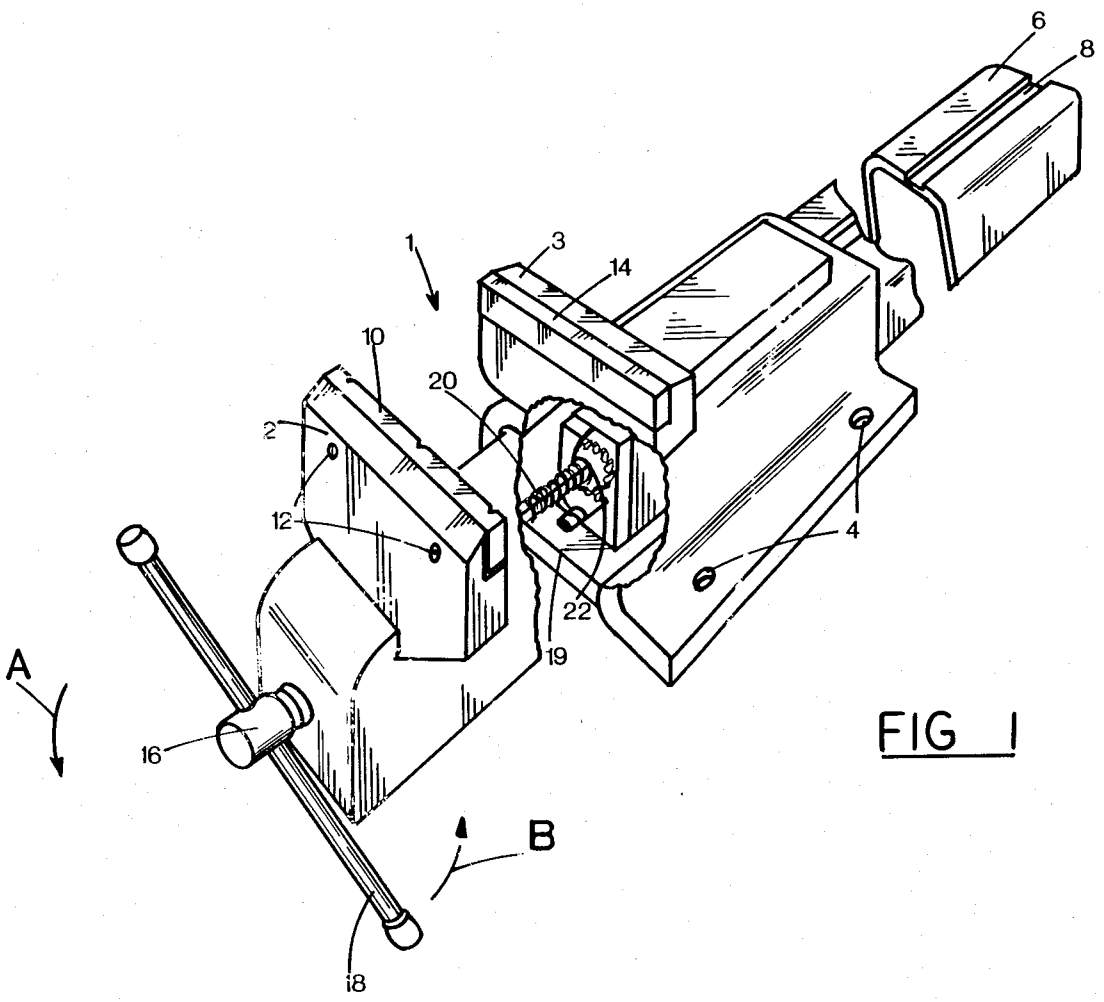
FIG. 1 is a perspective view, partly broken away, of a clamping device according to an embodiment of the invention.

A clamping device according to the invention is exemplified by a vise 1 shown in the drawings. As seen from the exterior in FIG. 1, the vise appears conventional. The vise includes a first jaw member 2 and a second jaw member 3. The second jaw member is normally fixed to a working surface, such as a work bench, by means of bolts extending through bolt holes 4. The first jaw member 2 has a slide 6 which extends slidably through the second jaw member 3. Slide 6 has a keyway 8 on the top thereof. The first jaw member 2 has a jaw 10 secured to the rest of the first jaw member by a pair of screws 12. The second jaw member 3 has a similar and opposing jaw 14. A screw spindle 16 is rotatably mounted on the first jaw member 2. A handle 18 is located on the screw spindle 16. As described thus far, the vise 1 is conventional.

As seen in FIG. 1, the slide 6 is channel-shaped and opens downwardly. A mounting plate 19 of the second jaw member 3 extends across the slide. The screw spindle 16 comprises the outer part of a screw 20 shown in FIG. 1. Screw 20 is provided with a keyway 22.

Figure 2:
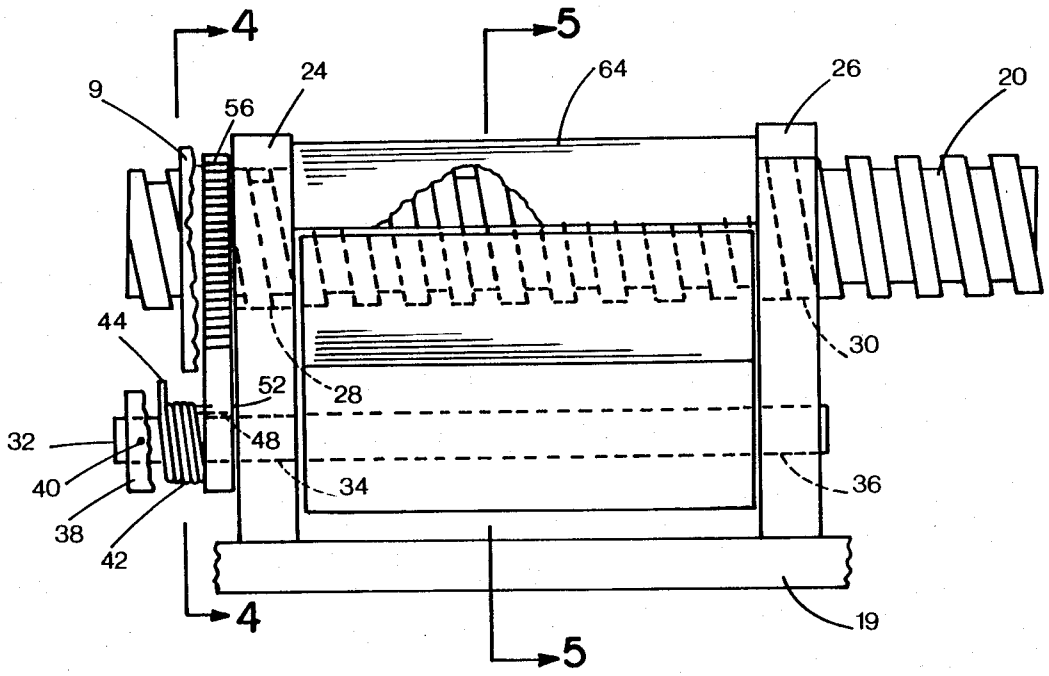
FIG. 2 is a fragmentary side view of a portion of the screw, half nut and mechanism for engaging or disengaging the half nut and the screw of the clamping device of FIG. 1.

The vise 1 is provided with a mechanism for engaging the second jaw member 3 with the screw or disengaging the second jaw member from the screw. This mechanism shown in better detail in FIGS. 2 and 3, includes a pair of spaced-apart supports 24 and 26 which are generally plate-like and are connected to the mounting plate 19 by such means as welding. The screw 20 extends slidably through apertures 28 and 30 in supports 24 and 26 as indicated by broken lines in FIG. 2.

A shaft 32 is rotatably journalled in apertures 34 and 36 of supports 24 and 26 below the screw 20. A spring cap 38 is connected to one end of shaft 32 by means of a pin 40. Pin 40 prevents rotation of the spring cap relative to the shaft 32. A coil spring 42 is coiled about shaft 32 between the cap 38 and the support 24. The spring 42 has a first end 44 received within a slot in the spring cap 38. The coil spring has a second end 48 inserted in a small aperture 50 of a gear wheel segment 52 with gear teeth 54. The coil spring 42 therefore provides a torsionally resilient connection between the shaft 32 and the gear wheel segment 52.

Figure 3:
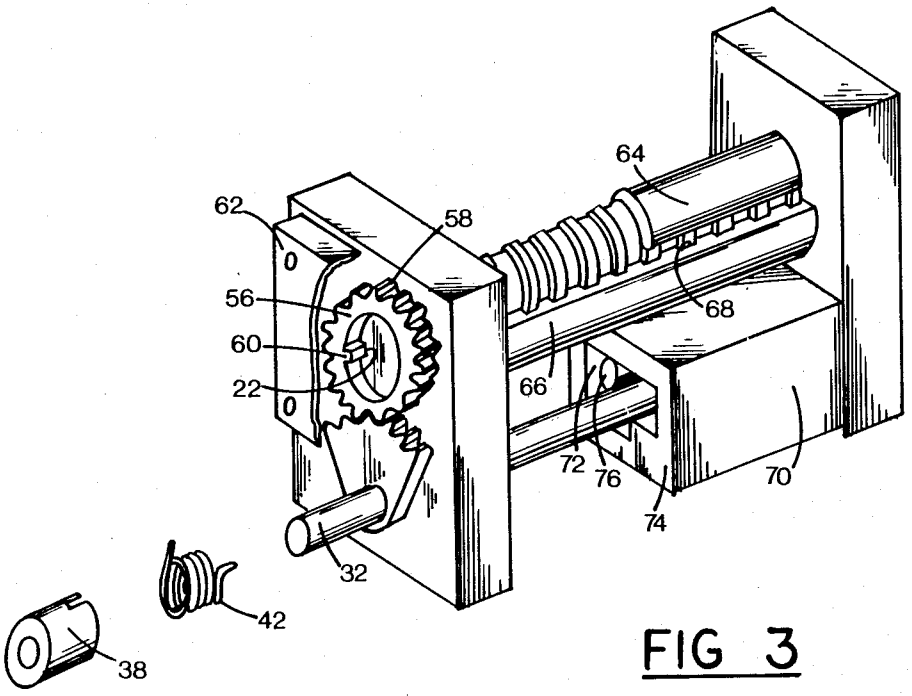
FIG. 3 is a fragmentary perspective view, partly broken away and partly exploded, showing the screw and half nut of a clamping device similar to that of FIG. 1 and the mechanism for engaging or disengaging the half nut and the screw, the half nut being narrower and the cam follower being wider than the embodiment of the other figures.
Figures 4, 5, 6:
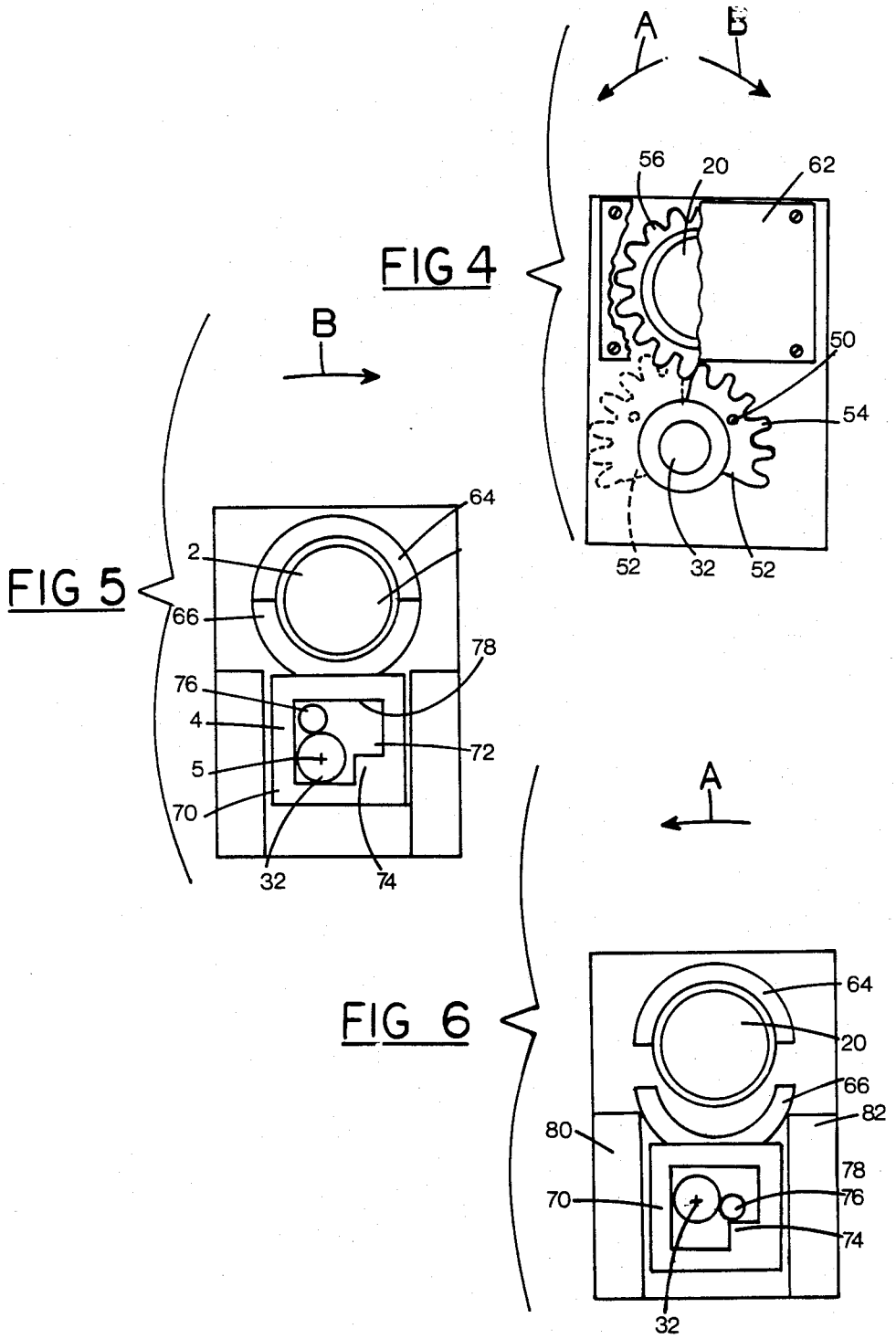
FIG. 4 is a sectional view taken along line 4—4 of FIG. 2.
FIG. 5 is a sectional view taken along line 5—5 of FIG. 2 with the half nut and screw engaged.
FIG. 6 is a sectional view equivalent to that of FIG. 5 with the screw and half nut disengaged.

As seen best in FIGS. 3 and 4, gear wheel segment 52 is in the shape of approximately $\frac{1}{4}$ of a gear wheel with one extra of the gear teeth 54. The gear segment 52 meshes with a gear wheel 56 provided with a plurality of gear teeth 58. Gear wheel 56 has a key 60 slidably received within the keyway 22 of the screw 20. A sheet metal guard 62 is fitted over the gear wheel 56 and connected to support 24. This keeps the gear 56 in position against support 24 although screw 20 is slidably received in the longitudinal direction by the gear wheel.

A half cap 64 is connected to both supports 24 and 26 and extends therebetween. The half cap is in the shape of a hollow half cylinder and slidingly engages screw 20. The half cap 64 therefore provides bearing support for screw 20 when the screw is pushed upwardly from the point of view of FIG. 2 or FIG. 3.

A half nut 66 extends between supports 24 and 26 on the side of the screw 20 opposite half cap 64. However, half nut 66 is not connected to the support. The half nut is in the shape of a hollow half cylinder with internal female threads 68 shaped to engage with the threads of screw 20. The half nut is connected to a box-shaped cam follower 70. The cam follower 70 has a center opening 72 which is substantially square except for a stop 74 in one corner thereof. The shaft 32 extends through center opening 72. A cam lobe 76, in the shape of a short cylindrical rod, is connected to shaft 32 within the center opening of the cam follower by suitable means such as welding.

OPERATION

In order to position a work piece between jaws 10 and 14, screw 20 is rotated at least 90° in the counterclockwise direction by means of handle 18 on screw spindle 16. This counterclockwise rotation is represented by arrow A in FIG. 1. As seen in FIG. 4, rotation of the screw 20 rotates gear wheel 56 which meshes with gear wheel segment 52. It may readily be appreciated that gear wheel segment 52 is thereby rotated to the extreme position indicated by the solid lines in FIG. 4. As mentioned above, gear wheel segment 52 is connected to shaft 32 by means of spring cap 38, pin 40 and coil spring 42. The rotation of the gear segment thereby rotates the shaft 32 and cam lobe 76 to the position shown in FIG. 6. Further rotation of the shaft is prevented by cam lobe 76 striking stop 74. If screw 20 is rotated further in the counterclockwise position from the point of view of FIG. 1, further rotation of shaft 32 is prevented and gear wheel 56 engages the final tooth of gear wheel segment 52 in a ratchet-like manner. Each time the final tooth of the gear segment is deflected by gear wheel 56, it is returned to a position in engagement with the gear wheel under the action of coil spring 42.

As seen in FIG. 6, rotation of screw 20 in the counterclockwise direction A from the point of view of FIG. 1 and FIG. 6, causes cam lobe 76 to rotate downwardly away from inner face 78 of cam follower 70. The cam lobe 76 contacts stop 74 and moves cam follower 70 and half nut 66 away from screw 20. The action is stopped when the half nut 66 contacts side supports 80 and 82 as shown in FIG. 6. Since half nut 66 is now completely clear of the screw, there is no engagement between the first jaw member 2 and the second jaw member 3. The user therefore can pull the jaws of the vise apart to the required position or adjust the jaws closer together as desired.

When a clamping action is desired, the user rotates screw 20 at least 90° in the clockwise direction from the point of view of FIG. 1 as indicated by arrow B. This rotation of the screw rotates gear wheel 56 and gear segment 52 to the position shown in broken lines in FIG. 4. At the same time, shaft 32 and cam lobe 76 are rotated to the position of FIG. 5. Cam lobe 76 contacts inner face 78 of the cam follower 70 and raises the cam follower and half nut 66 to a position wherein the half nut threadedly engages the screw 20 as shown in FIG. 5. Again, further rotation of the screw in this clockwise direction causes a ratcheting action as the gear wheel 56 engages on the last tooth of the gear wheel segment.

The vise jaws therefore may be tightened to the required degree by further rotation of the screw in the clockwise direction B of FIG. 1 in the standard manner.

It may be observed, therefore, that the invention provides a quick release and instantaneous grip vise which may be controlled simply by one handed operation using handle 18.

What is claimed is:

1. A clamping device comprising:

a first jaw member;

a second jaw member;

a screw having a screw spindle rotatably mounted on the first jaw member;

a half nut mounted on the second jaw member;

a cam means operatively connecting the screw to the half nut so that the half nut is engaged with the screw or disengaged from the screw by rotation of the screw, the cam means comprising a cam and a cam follower, the half nut being mounted on the cam follower;

gear means connecting the screw to the cam means, the gear means comprising a gear wheel connected to the screw and a gear wheel segment connected to a cam lobe;

a cam spindle connected to the cam, the gear wheel segment being rotatably mounted on the cam spindle; and resilient means connecting the gear wheel segment to the cam spindle.

2. A clamping device as claimed in claim 1, wherein the resilient means comprises a coil spring received about the cam spindle and having a first end connected to the cam spindle and a second end connected to the gear wheel segment.

3. A clamping device as claimed in claim 2, further comprising a handle mounted on the screw spindle, the cam and the cam follower being configured such that rotation of the handle in a clockwise direction engages the half nut with the screw and rotation of the handle in a counterclockwise direction disengages the half nut from the screw.

4. A clamping device as claimed in claim 3, wherein the cam follower is box-shaped, the cam being within the follower and having a cam lobe, the cam lobe being rotatable to a position pointing generally towards the screw to engage the half nut and the screw and being rotable to a position pointing away from the screw to disengage the half nut and the screw.

5. A clamping device as claimed in claim 4, further comprising stops on the cam follower to limit rotation of the cam in both rotational directions.

* * * * *